United States Patent [19]

Martin

[11] Patent Number: 4,641,379

[45] Date of Patent: Feb. 10, 1987

[54] FACE MASK

[76] Inventor: Thomas S. Martin, 4045 Hwy. 33 West, West Bend, Wis. 53095

[21] Appl. No.: 855,553

[22] Filed: Apr. 25, 1986

[51] Int. Cl.[4] ..... A41D 13/00; A62B 18/02

[52] U.S. Cl. ..... 2/9; 2/206; 128/206.28

[58] Field of Search ..... 2/9, 206, 424, 436; 128/201.17, 206.28

[56] References Cited

U.S. PATENT DOCUMENTS

| | | | |
|---|---|---|---|
| 780,616 | 1/1905 | Palmer | 2/206 |
| 2,174,523 | 10/1939 | Manson | 128/206.28 |
| 3,768,100 | 10/1973 | Colman et al. | 2/9 |
| 3,878,563 | 4/1975 | Pulju | 2/9 |
| 4,300,240 | 11/1981 | Edwards | 2/206 |
| 4,520,509 | 6/1985 | Ward | 128/206.28 X |

*Primary Examiner*—Werner H. Schroeder
*Assistant Examiner*—J. L. Olds
*Attorney, Agent, or Firm*—Wheeler Law Firm

[57] ABSTRACT

A flexible body portion covering substantially all of the face below the eyes of a wearer has nose and mouth openings. A flexible skirt affixed to the outer surface of the body portion along a seam which encompasses the nose and mouth openings and also at the tack points forms an air duct which directs expelled air and downwardly. In-turned flaps at the nose opening provide a seal around the wearer's nose. A stiff yet malleable arch affixed to the outer surface of the skirt prevent the mask from resting upon or rubbing against the wearer's nose. Broad lateral cheek rises provide vertical support.

3 Claims, 7 Drawing Figures

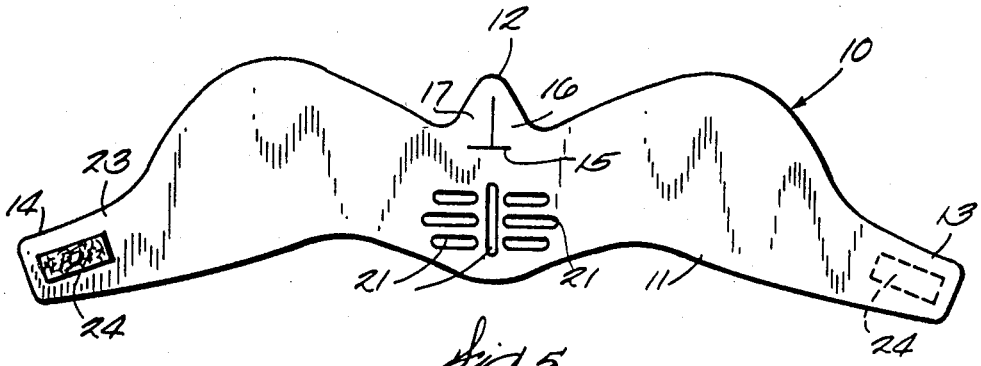
Fig. 5
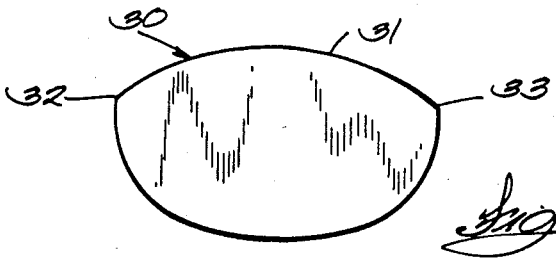
Fig. 6
Fig. 7
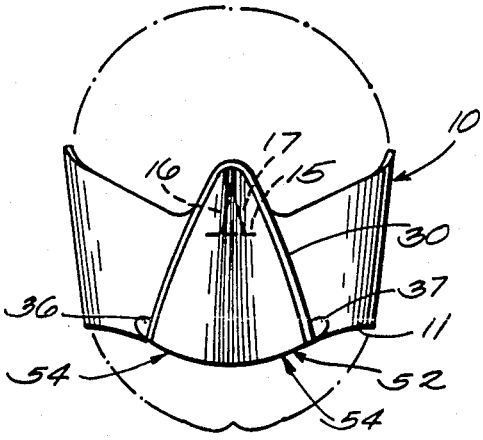

FACE MASK

BACKGROUND OF THE INVENTION

Snowmobiles and the like are frequently operated in sub-zero weather and at relatively high speeds making it necessary for the operator to wear a protective mask to prevent his face from freezing. A variety of protective face masks are known. For example, U.S. Pat. No. 167,543 (Kleinert), U.S. Pat. No. 2,344,920 (Maggi), U.S. Pat. No. 2,839,757 (Ganola), U.S. Pat. No. 3,768,100 (Colman, et. al.), U.S. Pat. No. 3,806,951 (Hulteman), U.S. Pat. No. 3,878,563 (Pulju), U.S. Pat. No. 4,285,068 (Ross), and U.S. Pat. No. 4,300,240 (Edwards). Masks are also useful to skiers, iceboaters and others.

When the snowmobile is operated for several hours, as is commonly the case, many of the prior art masks, which rely upon the bridge of the wearer's nose as a primary source of vertical support, will cause substantial irritation due to the vibration and jostling associated with snowmobiling. Alternatively the prior art masks are equipped with a nose opening, the edge of which will rub against the wearer's nose causing similar irritation. It is the intermittent contact (i.e. rubbing or tapping), of the mask against the wearer's nose which causes such irritation and discomfort to the wearer.

Additionally, and most critically when such masks are worn under a protective helmet, exhaled air which typically has a high moisture content, will fog the shield of such a helmet and the glasses worn by the operator. The prior art masks, therefore, frequently have a hood which covers the nose and mouth area designed to direct moisture-laden, exhaled air away from the operator's eyes. Usually, however, no seal is provided between the nose and eyes of the operator thereby allowing the warm air to migrate upward toward the shield of the helmet or operator's glasses and rendering the hood in large part ineffective. It should, of course, be understood that a protective face mask may be utilized for a variety of sports and activities other than snowmobiling but the use, operation and associated problems will be essentially similar.

SUMMARY OF THE INVENTION

The present invention provides an improved protective face mask for snowmobiles and the like which is simple, inexpensive to produce. A mask which neither is supported by nor taps against the wearer's nose thereby preventing the irritation resulting from vibrations associated with snowmobiling and the like. Instead, reversed flaps rest against the nose without displacement, holding a metal bridge that is shaped by the user so that it is clear of the bridge of the user's nose, being supported partly by the flaps and partly by high cheek areas that provide vertical support. The hood seam also adds strength. The combination of these elements combine to create an effective seal around the wearer's nose to prevent eyeglass or helmet shield fogging.

The present invention pertains to a improved protective face mask including a flexible body portion formed to cover the face below the eyes of the wearer with mouth openings formed therein and a nose cut creating flaps which when separated create an opening for the nose. The flaps prevent the mask from resting upon and being supported by the bridge of the wearer's nose. By being in continuous contact with the sides of the wearer's nose in a spring-like manner, the flaps prevent the irritation caused by the mask coming in intermittent contact with (i.e., tapping against) the wearer's nose. Additionally, the flaps, which are not displaced from the wearer's nose create a tight seal around the nose to prevent any exhaled, moisture-laden air from migrating upward and fogging the wearer's glasses or helmet shield.

The body portion further has broad left and right lateral cheek rises formed therein which serve as the primary source of vertical support. A flexible skirt is affixed to the outer surface of the body portion forming a hood over the nose cut and mouth openings which directs expelled air downward and provides a circuitous path to warm air prior to inhalation by the wearer. The skirt is further attached to the front of the body portion at two tack points which do not allow the hood to contact either the wearer's nose or protective helmet, thereby preserving the seal created by the in-turned nose flaps. The mask is affixed to the wearer's head by means of two stretchable bands formed from the ends of the body portion. Attached to the bands is a means for joining the bands together. In addition, a stiff yet malleable arch which can be shaped to suit each wearer's facial feature is attached to the mask above and surrounding the nose cut which further helps prevent the mask from being supported by and coming in contact with the bridge of the wearer's nose and maintain the seal created by the in-turned nose flaps. The mask is constructed primarily of a material which is flexible, strong, an effective wind barrier and temperature insulating.

Other advantages of this invention will become apparent to those skilled in the art upon consideration of the accompaying specification, claims, and drawings.

DESCRIPTION OF THE DRAWINGS

FIG. 5 is a plan view of a blank for body portion.

FIG. 6 is a plan view of a blank for skirt.

FIG. 7 is a view in front elevation of the mask assembled and correctly positioned on a wearer.

DETAILED DESCRIPTION

Figure 1:
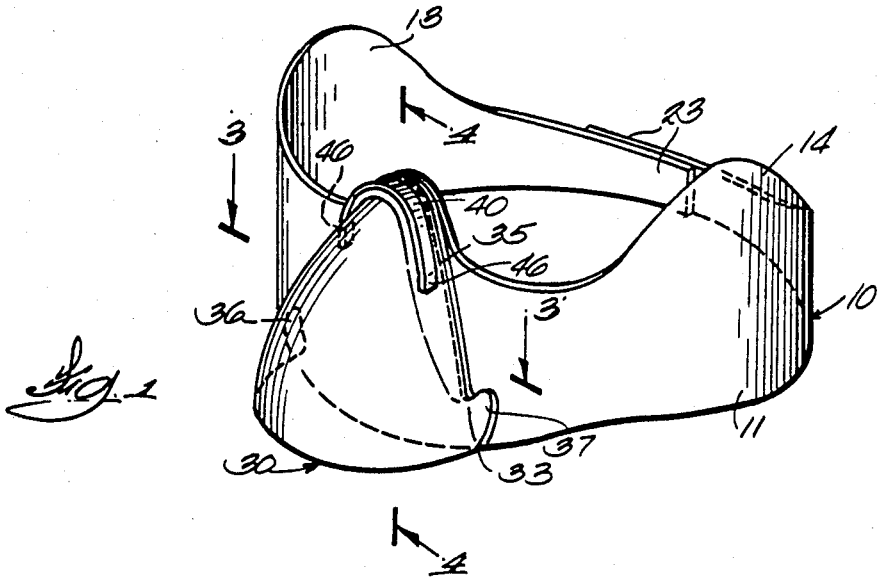
FIG. 1 is a perspective view of the mask of my invention.
Figure 2:
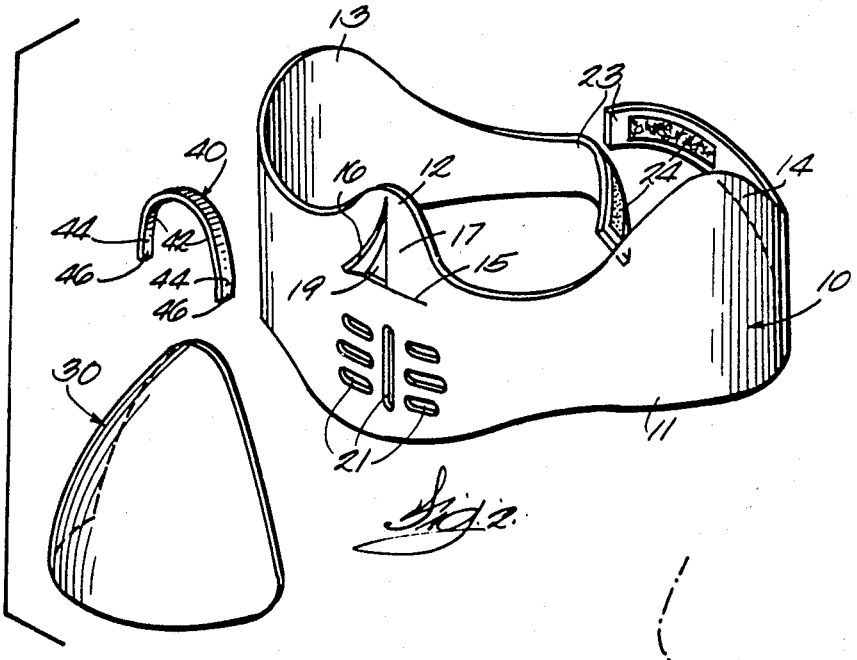
FIG. 2 is an exploded perspective view, similar to FIG. 1.
Figure 3:
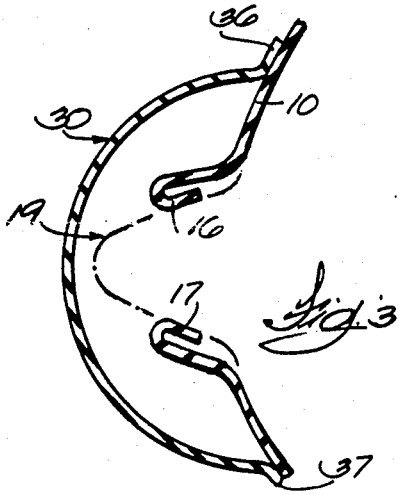
FIG. 3 is a cross sectional view on line 3—3 of FIG. 1.
Figure 4:
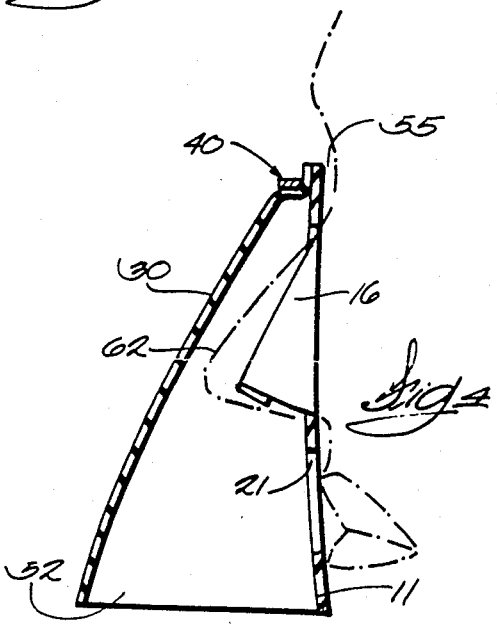
FIG. 4 is a cross sectional view on line 4—4 of FIG. 1.

Although the disclosure hereof is detailed and exact to enable those skilled in the art to practice the invention, the physical embodiments herein disclosed merely exemplify the invention which may be embodied in other specific structure. The scope of the invention is defined is the claims appended hereto.

In the figures the numeral 10 generally designates the body of the protective face mask illustrated in blank form in FIG. 5. The blank for the body 10 is cut from a flexible cloth-like material, preferably having a relatively air impervious outer surface which may be a fine nylon mesh, or rubber-like material, or the like and a relatively soft insulating inner surface which may be a thin layer of spongy plastic or rubber material, cotton, wool, etc. The blank for the body 10 has a relatively narrow center rise 12, and broader left and right lateral cheek rises 13 and 14, respectively. An inverted T-shaped nose cut 15 is cut into the body 10 just below the center rise 12 creating two flaps 16 and 17. When the mask is worn, this T-shaped cut 15 provides an opening 19 through which the wearer's nose 62 protrudes. Mouth openings 21 are cut in the body 10 which facilitate breathing and communication while the mask is worn. The elongated end portions (bands) 23 of the body 10 serve to maintain the mask in proper position over the wearer's face. Affixed to the bands 23 is a strip of Velcro or some other means for joining the two bands 23 behind the wearer's head 61.

Referring to FIG. 6, a flexible skirt 30 is illustrated in blank. The skirt 30 may be formed of the same material as the body 10. The top edge 31 of the skirt 30 is of a shape which allows the skirt 30 to be affixed to the front of the body 10 by some convenient means such as sewing or the like along an inverted generally U-shaped seam 35. The inner surface of the skirt 30 contacts the outer surface of the body 10, and the corners 32 and 33 of the skirt 30 lie on the bottom edge 11 of the body 10. The center rise 12 is located at the top of the U-shaped seam 35 and the sides of the U-shape seam 35 encompass the nose cut 15 and the mouth openings 21. The skirt 30 flairs out when it is attached to the body 10 along the U-shaped seam 35 forming an air duct 52 which directs exhaled air downward. The skirt 30 is further attached by sewing or some other convenient means to the body 10 slightly above the ends of and outside of the U-shaped seam 35. At these tack points 36 and 37 the outer surface of the skirt 30 is attached to the outer surface of the body 10. Rather than allow the skirt 30 to extend linearly away from the wearer's face the tack points 36 and 37 cause the skirt 30 to bend inwardly and fan laterally, thus avoiding contact with a helmet or the wearer's nose 62 and preventing displacement of the in-turned flaps 16 and 17 thereby preserving the seal around the wearer's nose 62.

An arch 40 is attached by glue or other appropriate means along the U-shaped seam 35 in the area of the center rise 12. The arch is made of aluminum or some other rigid yet malleable material. Each leg 42 of the arch 40 contains a bend 44 which sets off the base 46 of each leg 42 from the rest of the arch 40. The bases 46 of the arch 40 do not extend below the bottom of the nose cut 15. The skirt 30 and body 10 serve as a cushion between the bases 46 of the arch 40 and the wearer's face.

When the mask is being positioned on the wearer's face, the wearer first pulls the flaps 16 and 17 created by the nose cut 15 inward more than 90° to form springy support tabs and places his nose in the opening 19 created. Then holding the mask by the bands 23, the wearer stretches the mask slightly and joins the bands 23 behind his head. Being formed in the body 10 lower than the nose cut 15, stretching the bands 23 does not affect the seal created by flaps 16 and 17. Stretching the mask insures a snug fit and the left and right lateral cheek rises 13 and 14 dissipate the pressure on the wearer's face to provide a large degree of comfort. The lateral cheek rises 13 and 14 also maintain the mask correctly positioned on the face and prevent it from slipping downwardly or upwardly during use. The left and right lateral cheek rises 13 and 14 further serve to protect the cheeks 64 and ears 66 of the wearer from the cold while in no way obstructing his vision. Finally, and very importantly, rises 13 and 14 give vertical support in the plane of the mask to the area of arch 40 and seam 35 to raise seam 35 slightly off the bridge of the wearer's nose 62 under the urging of flaps 16 and 17 preserving the seal formed by flaps 16 and 17. The malleability of the arch 40 permits the adjustment of the distance between the bases 46 of the arch 40 to account for variations in the size and shape of the wearer's 62 nose and to maximize comfort.

The in-turned flaps 16 and 17 prevent the bases 46 of the arch 40 from existing any significant pressure on the wearer's face, and also help to maintain the space 55 between the bridge of the wearer's nose 62 and the mask. Space 55 allows the wearer to also wear eyeglasses without in any way affecting the sealing or comfort features of the mask. The spring-like manner in which the flaps 16 and 17 contact the sides of the wearer's nose 62 without displacement despite movement of the mask, because they roll slightly as they move, which causes the flaps 16 and 17 to absorb much of the vibration experienced thereby preventing irritation and creating a seal around the wearer's nose 62 to prevent fogging of any eyeglasses or helmet shield which the wearer may also be wearing.

What is claimed is:

1. A protective face mask for snowmobiling and the like having two joinable ends and a center line over the wearer's nose, and comprising:

(a) a flexible body portion covering substantially all of the face below the eyes of a wearer;

a relatively narrow center rise formed in said body portion; broader left and right lateral cheek rises formed in said body portion;

bands formed from the ends of said body portion;

a means for joining said bands together;

at least a pair of flaps formed by a nose cut at the vertical center line of said body portion below said center rise said flaps being sized and shaped to curl inwardly to flexibly contact the sides of the wearer's nose without displacement where said flaps contact the nose creating a seal around the nose and substantially preventing the mask from resting on the bridge of the wearer's nose;

at least one mouth opening formed in said body portion below said nose cut;

(b) a flexible skirt over the nose and mouth area having a top edge;

a generally inverted U-shaped seam located along the edge of said center rise and passing downwardly and outwardly along said top edge from said center rise on opposite sides of said nose cut and said mouth openings along which the entire top edge of said flexible skirt is affixed to the outer surface of said body portion.

2. A protective face mask of claim 1 further comprising a stiff yet malleable arch affixed to the outer surface of said skirt along said U-shaped seam in the area of said center rise which prevents the mask from being supported by the bridge of the wearer's nose.

3. The protective face mask of claim 1 further comprising at least two tack points located outside of said generally U-shaped seam at which the outer surface of said skirt is affixed to the outer surface of said body portion.

* * * * *